United States Patent [19]

Umann

[11] 3,995,326

[45] Dec. 7, 1976

[54] BIDET TOILET SEAT

[76] Inventor: Harry M. Umann, 8383 Wilsire Blvd., Suite 510, Beverly Hills, Calif. 90211

[22] Filed: Aug. 1, 1975

[21] Appl. No.: 601,229

[52] U.S. Cl. ..... 4/7

[51] Int. Cl.[2] ..... A47K 3/22; A47K 11/08

[58] Field of Search ..... 4/6, 7, 10

[56] References Cited

UNITED STATES PATENTS

| | | | |
|---|---|---|---|
| 1,866,930 | 7/1932 | Guidatti et al. | 4/7 |
| 2,762,058 | 9/1956 | Hurko | 4/7 |
| 3,107,359 | 10/1963 | Saulson | 4/6 |
| 3,154,793 | 11/1964 | Congdon | 4/7 |
| 3,196,250 | 7/1965 | Umann | 219/371 |
| 3,247,524 | 4/1966 | Umann | 4/7 |
| 3,308,847 | 3/1967 | Umann | 137/613 |

*Primary Examiner*—Henry K. Artis
*Attorney, Agent, or Firm*—Lyon & Lyon

[57] ABSTRACT

A toilet seat having an antisiphon bidet nozzle, an antisiphon vaginal wash nozzle, and the toilet seat forming housing for receiving a deodorant container, a warm air blower, a water heater, a manually accessible pressure regulator, a medication container, and appropriate manually operated valve and switches for supplying water to the bidet and vaginal nozzles, and actuating the blower, the toilet seat having an adjustable mounting means for attachment to the toilet seat mounting means of a wide variety of toilet bowls.

12 Claims, 9 Drawing Figures

BIDET TOILET SEAT

BACKGROUND OF THE INVENTION

This invention is related to prior inventions disclosed in U.S. Pat. Nos. 3,247,524, 3,308,847 and 3,196,250, and while utilizing components having a similar purpose, accomplishes this in a more facile manner.

SUMMARY OF THE INVENTION

The present invention is directed to a bidet toilet seat adapted to be mounted on a toilet bowl in place of a conventional toilet seat and is summarized in the following objects:

First, to provide a bidet toilet eeat wherein all of the components are contained in a single housing dimensioned and shaped to form a toilet seat.

Second, to provide bidet toilet seat, as indicated in the previous object, wherein the rear portion of the housing is increased in height to accommodate some of the components and is provided with a raised hinge means to permit tilting of the toilet seat housing and its contents as a unit; the hinge means including a novelly arranged mounting means whereby the toilet seat may be fitted to a wide variety of conventional toilet bowls.

Third, to provide a bidet toilet seat, as indicated in the other objects, wherein a bidet nozzle is provided at the hinged end of the toilet seat and is connected to the water supply through a novelly arranged air gap antisiphon means.

Fourth, to provide a bidet toilet seat, as indicated in the preceeding objects, which is provided with a douche nozzle at the extended end of the toilet seat, also provided with an air gap antisiphon means, and arranged for attachment to internal irrigation means.

Fifth, to provide a bidet toilet seat, as indicated in the preceeding object, wherein a novelly arranged medicament container may be incorporated in the water supply line to the douche nozzle, the container being arranged for access to refill by raising the toilet seat.

Sixth, to provide a bidet toilet seat having simple controls readily accessible at a lateral edge of the toilet seat housing.

Figure 1:
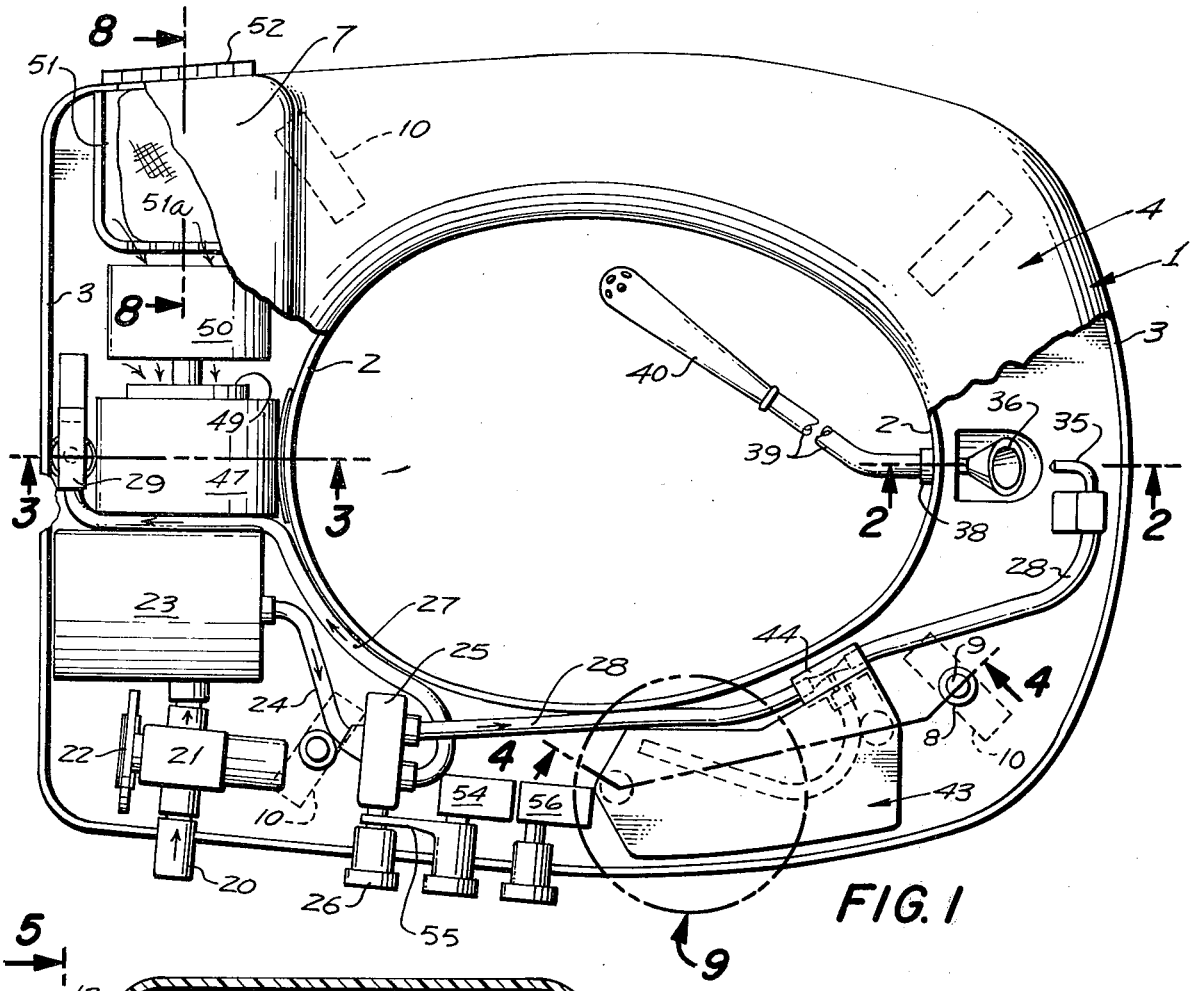
FIG. 1 is a plan view of the bidet toilet seat with portions of the upper housing component broken away to expose internal mechanisms.

The bidet toilet seat includes a lower toilet seat component 1, having a central opening and including an upwardly directed radially inner-marginal rim 2 and an upwardly directed radially outer-marginal rim 3. A complementary upper toilet component 4 having downwardly directed radially inner marginal rim 5 and a radially outer marginal rim 6 overlies the lower toilet seat component. The corresponding marginal rims are in mutual engagements. The rear portion of the upper toilet seat component 4 is provided at its rear side with a raised portion 7. The toilet seat components are provided with mutually engageable bosses 8 which receive a bolt 9 inserted upwardly through the lower toilet seat component 1. The protruding lower ends of the bolts 9 are covered by pads 10 which support the lower toilet seat component 1 on a conventional toilet bowl 11.

A hinge 12 is secured to the raised portion 7 along its rear side adjacent its upper extremity and is also secured to a mounting plate 13 confronting the rear side of the raised portion 7. The lower edge of the mounting plate 13 is provided with a channel 14. The channel 14 receives upwardly directed portions of a pair of angle brackets 15 which are adapted to be secured in various positions along the channel by means of screws 16. Each angle bracket 15 includes a horizontal portion which may be provided with two or more holes to receive mounting studs 17, each provided with an offset head 18 so proportioned as to cover the horizontal portion of the bracket 15 while permitting the corresponding screw to be inserted in a selected perforation. By this arrangement the screws 16 may be adjusted so as to accomodate the various locations of mounting holes provided in conventional toilet seats. The unused portions of the channel 14 may receive extensions 19 complementary to the vertical portions of the angle brackets 15.

The upper and lower toilet seat components form an annular chamber and their radially outer rims define an opening to receive a water inlet 20. The water inlet 20 connects to a pressure regulator 21 which may be of the type shown in U.S. Pat. No. 3,247,524 and 3,308,847. The pressure regulator 21 is provided with a hand wheel 22 a portion of which is exposed for manual engagement. The outlet from the pressure regulator is connected to a water heater 23 which may be of the type shown in U.S. Pat. No. 3,247,524. The water heater is connected by a water line 24 to a selector valve 25 having a handle 26 protruding from the toilet seat components. The selector valve is conventional and is provided with an outlet connected to a bidet supply line 27 and a douche supply line 28.

Figure 3:
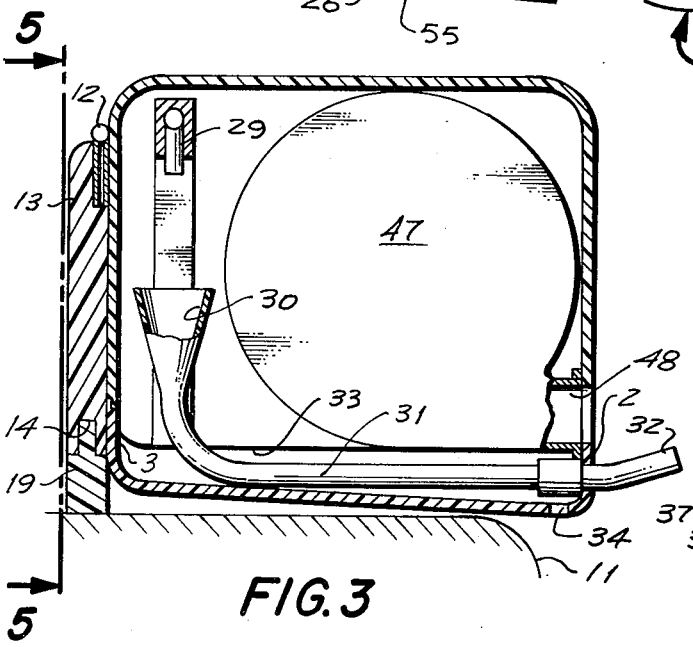
FIG. 3 is an enlarged transverse sectional view taken through 3—3 of FIG. 1.
Figure 2:
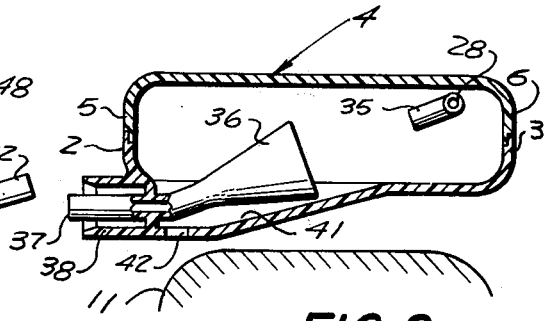
FIG. 2 is an enlarged fragmentary transverse view taken through 2—2 of FIG. 1.

The bidet supply line terminated at a jet outlet 29 located at the backside of the toilet seat component and directed downward, as shown in FIG. 3. Water jetting from the outlet 29 is directed into a collector funnel 30 spaced downward from the jet outlet and thus forming an antisiphon means. The collector funnel is joined to a bidet tube 31 including a horizontal portion terminating in a bidet nozzle 32 protruding from the rear portion of the lower toilet seat component 1 in alignment with the forward-rearward axis of the opening formed by the toilet seat components. The collector funnel 30, bidet tube 31 and nozzle 32 are of larger diameter than the jet outlet 29, so that all of the water received by the funnel 30 is discharged through the nozzle 32. The water retains sufficient velocity, that an adequate stream may be directed against the anal region of a person seated on the bidet toilet seat. The bidet tube 31 is received in the draim channel 33 formed in the lower toilet seat component and having a drain opening 35. The drain channel 33 serves to lower the position of the bidet nozzle 32.

The douche supply line 28 is connected to a jet outlet 35 located at the forward portion of the bidet toilet seat and is directed downwardly and radially inward. Disposed in alignment, but spaced from the outlet 35 is a collector funnel 36 which is joined to a douche nozzle 37 projecting into the opening provided by the toilet seat. The douche nozzle is surrounded by a sleeve 38, spaced radially therefrom, whereby a douche tube 39 may be inserted between the sleeve at the nozzle 37. The douche tube is provided with a conventional douche fitting 40. The douche nozzle 37 and a portion of the funnel 36 is positioned in a drain channel 41 formed in the lower toilet seat component 1 and provided with a drain outlet 42.

Figure 4:
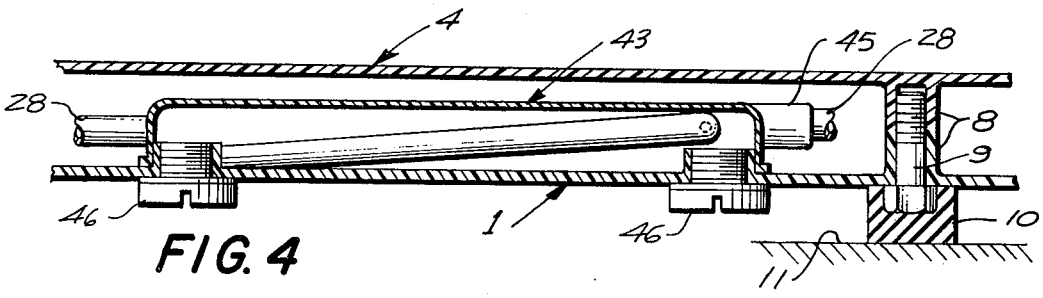
FIG. 4 is an enlarged fragmentary sectional view taken through 4—4 of FIG. 1.
Figure 5:
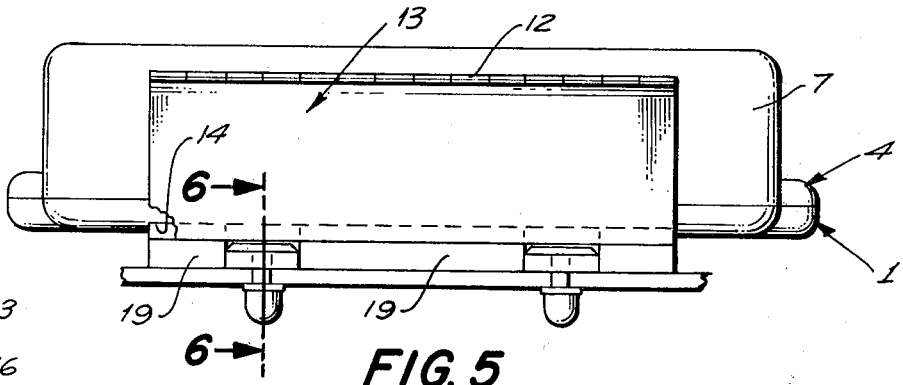
FIG. 5 is a back view of the bidet toilet seat, showing the manner in which the toilet seat is mounted on a toilet bowl.
Figure 6:
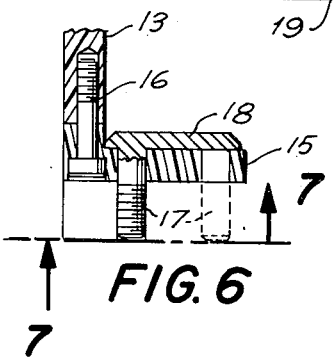
FIG. 6 is an enlarged fragmentary sectional view taken through 6—6 of FIG. 5.

The lower toilet seat component 1 may be arranged to accommodate a medicament container 43 located between the selector valve 25 and the jet outlet 35. Mounted at one side of the container 43 is a siphon unit 44, having an inlet communicating with the container to an inlet tube 45. The lower wall of the container may be integral with the lower toilet seat component 1 as shown in FIG. 4 and is provided with one or more openings normally closed by plugs 46. The siphon unit 44 is interposed in the douche supply line 28. Alternatively, a modified siphon unit **44*a* may be connected through a tube 44*b* to a medicament container 43*a* disposed externally of the toilet seat. A conventional separable connector, not shown, may be provided between the siphon unit 44*a* and tube 44*b*.**

By providing plugs 46 at opposite ends of the container 43, the container 43 may be filled or drained by tilting the toilet seat to an upright position exposing the plugs 46.

Centered in the raised portion 7 over the bidet nozzle 32 is a blower 47 provided with a heater, which may be of the type shown in U.S. Pat. No. 3,196,250. The blower 47 is provided with an outlet 48 disposed immediately above the bidet nozzle 32 and is provided with a laterally disposed inlet 49, disposed between the blower 47 and a motor 50.

Figure 8:
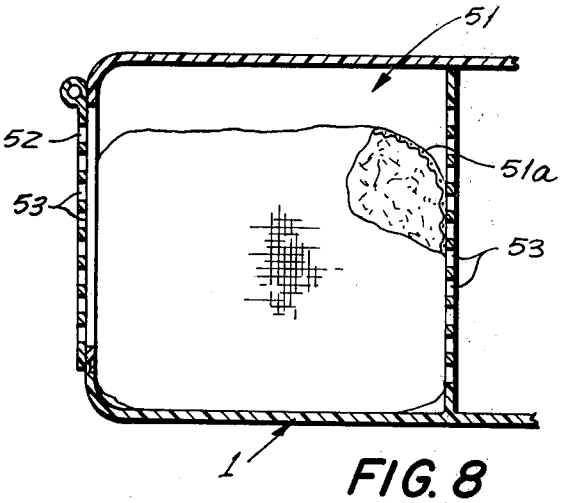
FIG. 8 is an enlarged fragmentary sectional view taken through 8—8 of FIG. 1.
Figure 7:
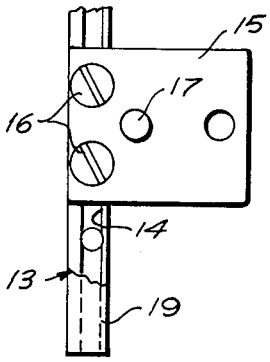
FIG. 7 is a fragmentary bottom view taken from 7—7 of FIG. 6.
Figure 9:
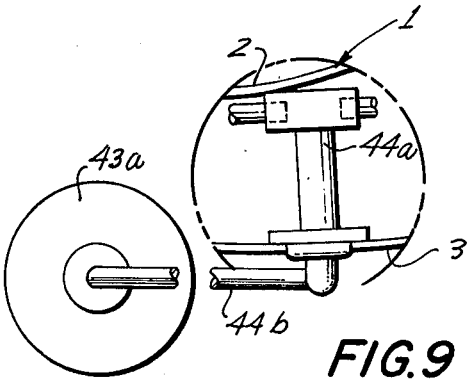
FIG. 9 is a fragmentary top view taken within Circle 9 of FIG. 1 showing a modified siphon means for connection to an external medicament container.

Also included in the raised portion 7 is a deodorant chamber 51 accessible from the side of the raised portion 7 through a hinged door 52 for insertion of a porous wall bag **51*a* of a deodorant. The deodorant chamber and door are provided with perforations 53, as shown in FIG. 8. The chamber and bag 51 thus forms a portion of the passageway for supplying air to the blower 47.**

Mounted at one side of the selector valve 25 is a bidet or rectal wash switch 54, having an arm 55 which may be engaged when the handle of the selector valve is operated to supply water to the bidet nozzle 32. A second switch 56 is located adjacent to the switch 54 and is arranged to operate the blower 47.

Operation of the bidet toilet seat is as follows:

The water heater 23 is provided with its own thermostat control so that an initial supply of warm water is available. The selector valve 25 is normally in a closed position; that is, closing supply to both the bidet nozzle 32 and the douche nozzle 37.

The selector tube 25 is normally open to the bidet nozzle; however, a solenoid valve not shown within the water heater 23 is closed. The switch 54, which is normally open, controls the solenoid valve as well as the heating coil, not shown, in the water heater.

By closing the switch 54, the solenoid valve is opened permitting water flow from the heater 23, through lines 24 and 27, then jetted from the outlet 29 into the cone 30, tube 31 and finally out the bidet nozzle 32. Only a few ounces of pressure at the nozzle 32 is required, but the capacity of the nozzle is of sufficient greater size than the outlet 29, that adequate flow occurs. Thus the spaced relation of the outlet 29 and cone 30 insures that high velocity water, which might be damaging, is avoided. The flow continues as long as the switch 54 is manually held in its closed position.

When the douche nozzle 37 is in operation, the siphon 44 draws medicament fluid from the container. To releive any vacuum that may form, it is only necessary to release the switch 54 momentarily so that back flow from the outlet 35 may occur.

By pressing on the separator valve handle, the valve is shifted to close the line 27, open the line 28, leading to the douche nozzle and douche fitting 40, and through the arm 55 and close the switch 54. Again the capacity of the douche nozzle 37 and the connection to the fitting is ample to supply water internally, while insuring that the pressure remain at a safe low level. Should the douche nozzle be closed by tissue or for other reason, the water will merely discharge into the toilet bowl throught the opening 42.

The switch 56, when closed, activates the blower 47 which draws air through the deodorizer, then heats the air for discharge from the outlet under a person seated on the toilet seat.

Having fully described my invention it is to be understood that I are not to be limited to the details herein set forth, but that may invention is of the full scope of the appended claims.

I claim:

1. A bidet toilet seat, comprising:

a. a housing in the form of a toilet seat having a central opening:

b. a downwardly directed water jet outlet within the housing;

c. means including a supply line contained in the housing for supplying heated water under pressure for jet discharge of water therefrom;

d. a collector funnel space downwardly from the jet outlet in the path of water jetted therefrom for receiving the water jetted therefrom and forming with the jet outlet an antisiphon means;

e. and a bidet nozzle connected to the collector funnel and positioned at the hinged side of the housing for discharging water into the central opening.

2. A bidet toilet seat, as defined in claim 1, which further comprises:

a. a second supply line for warm water;

b. a second downwardly directed water jet outlet within the housing connected to the second supply line;

c. a second collector funnel spaced downwardly from the second jet outlet for receiving water jetted therefrom;

d. and a douche nozzle connected to the second collector funnel and directed into the central opening thereof, said douche nozzle adapted for connection to a douche tube having douche fitting.

3. A bidet toilet seat as defined in claim 1, wherein:

a. a hinge means is provided for mounting the housing over a toilet bowl whereby the entire housing is pivotable between a horizontal position and an upright position.

4. A bidet toilet seat as defined in claim 2, wherein:

a. a container for liquid medicament is disposed within the toilet seat housing, said container having at least one inlet opening fitted with a removable closure, the opening facing the underside of the toilet seat when the toilet seat is in its horizontal position and exposed for access when the toilet seat is in its upright position;

b. and siphon means connecting the container with the second supply line.

5. A bidet toilet seat as defined in claim 1, wherein:

a. the water supply means includes a water pressure regulator and water heater disposed in the toilet seat housing, the regulator having an exposed manual control for regulating the water pressure, thereby to regulate the temperature of the water.

6. A bidet toilet seat as defined in claim 5, wherein:

a. selective control means disposed in the toilet seat housing is interposed in both supply lines and includes an externally accessible manually operable handle for selecting the bidet nozzle or douche nozzle.

7. A bidet toilet seat as defined in claim 1, wherein:

a. a blower and air heater is disposed within the toilet seat housing and included a discharge duct directed into the central opening of the toilet seat housing.

8. A bidet toilet seat as defined in claim 3, wherein:

a. the hinged side of the housing is increased in vertical dimension;

b. the hinge means is disposed at the top margin thereof and includes a hinge plate confronting the hinged side thereof, means for locating a pair of hinge brackets in various positions relative to the hinge plate, and having a plurality of bolt openings whereby a pair of bolts may be variously positioned for insertion into matching perforations provided in a toilet bowl.

9. A bidet toilet seat as defined in claim 1, wherein:

a. the hinged side of the housing is increased in vertical dimension;

b. a blower and air heater is disposed therein the blower having a discharge duct directed into the central opening of the toilet seat housing, and a laterally directed inlet;

c. a deodorant container is disposed in laterally offset relation to the blower inlet and exposed to the upper side of the toilet seat housing;

d. a removable lid overlies the container;

e. and means is provided including the container and housing forming a passageway through the contents of the container communicating with the inlet to the blower.

10. A bidet toilet seat, comprising:

a. a lower housing component having a central opening and upturned marginal walls;

b. an upper housing component having a mating central opening and mating downturned marginal walls;

c. fastener means joining the components with their walls in mutual contact, to form an annular chamber;

d. the upper housing component having a raised portion at one side of the central opening;

e. hinge means connected to the side of the raised portion remote from the central opening;

f. mounting means for connecting the hinge means to the back side of a toilet bowl for pivotal movement of the housing components between a horizontal position overlying the toilet bowl and an upright position;

g. a water pressure regulator, a water reservoir and heater, a water jet outlet, an air blower and an air heater assembled in the raised portion of the upper housing, the air blower having an outlet directed into the central opening, the water jet outlet being connected to the water heater and downwardly directed;

h. an upwardly directed collector funnel spaced below the jet outlet for receiving water jetted downwardly therefrom and forming therewith an antisiphon means;

i. and a bidet nozzle at the bottom of the raised portion of the annular chamber directed toward the central opening, the bidet nozzle being connected to the collector funnel.

11. A bidet toilet seat, as defined in claim 10, which further comprises:

a. a douche nozzle protruding from the annular chamber in circumferentially displaced relation to the bidet nozzle and directed into the central opening;

b. a second collector funnel connected to the douche nozzle and directed downwardly and inwardly from the annular chamber;

c. a second water jet outlet disposed within the annular chamber and spaced from the second collector said outlet being connected to the water reservoir and heater;

d. and a selective valve means within the annular chamber and interposed between the water heater and the water jet outlets.

12. A bidet toilet seat, as defined in claim 11, wherein:

a. a fluid medicament container is provided in the annular chamber and includes at least one capped filler opening extending through the lower housing component for access when the housing components are in their upright position;

b. and a siphon element is interposed between the selective valve means and the second water jet outlet.

* * * * *